US007788748B2

(12) United States Patent
Wurdeman

(10) Patent No.: US 7,788,748 B2
(45) Date of Patent: Sep. 7, 2010

(54) HOSPITAL BEDS WITH A ROTATING SLEEP SURFACE THAT CAN TRANSLATE INTO A CHAIR CONFIGURATION

(75) Inventor: Byron Wade Wurdeman, Elkin, NC (US)

(73) Assignee: Piedmont Global Solutions, Inc., Oak Ridge, NC (US)

( * ) Notice: Subject to any disclaimer, the term of this patent is extended or adjusted under 35 U.S.C. 154(b) by 161 days.

(21) Appl. No.: 11/398,098

(22) Filed: Apr. 5, 2006

(65) Prior Publication Data

US 2007/0017029 A1 Jan. 25, 2007

Related U.S. Application Data

(60) Provisional application No. 60/668,859, filed on Apr. 6, 2005.

(51) Int. Cl.
*A47B 71/00* (2006.01)

(52) U.S. Cl. ..... 5/600; 5/613; 5/618; 5/611

(58) Field of Classification Search ..... 5/616–618, 5/81.1 R, 611, 600, 613
See application file for complete search history.

(56) References Cited

U.S. PATENT DOCUMENTS 3,053,568 A 9/1962 Miller et al.
3,112,500 A 12/1963 Macdonald
3,239,853 A 3/1966 MacDonald
3,304,116 A 2/1967 Stryker
3,428,307 A * 2/1969 Kennedy et. al. ..... 5/601
3,503,082 A 3/1970 Kerwit
3,526,008 A 9/1970 Pruim
4,038,709 A 8/1977 Kerwit
4,084,274 A 4/1978 Willis et al.
4,183,109 A 1/1980 Howell
4,439,880 A 4/1984 Koncelik et al.
4,489,449 A * 12/1984 Failor et al. ..... 5/83.1
4,592,104 A 6/1986 Foster et al.
4,847,929 A 7/1989 Pupovic
4,862,529 A 9/1989 Peck
4,926,457 A 5/1990 Poehner et al.
5,014,391 A 5/1991 Schulte
5,072,463 A 12/1991 Willis
5,083,625 A * 1/1992 Bleicher ..... 180/65.1
5,095,561 A 3/1992 Green et al.
5,230,113 A * 7/1993 Foster et al. ..... 5/608
5,348,326 A 9/1994 Fullenkamp et al.
5,444,883 A * 8/1995 Iura ..... 5/618
5,613,254 A 3/1997 Clayman et al.
5,715,548 A 2/1998 Weismiller et al.

(Continued)

OTHER PUBLICATIONS http://www.hill-rom.com/usa/TotalCare.htm, *The TotalCare®*, 13 pages, 2006©.

(Continued)

*Primary Examiner*—Fredrick Conley
(74) *Attorney, Agent, or Firm*—Myers Bigel Sibley & Sajovec, P.A.

(57) ABSTRACT

A vehicle for use in hospitals, and the like, giving better mobility, steering, braking and passenger handling while providing comfort to the passengers from the time they lay down until they are standing on the side through the rotation and tilting ability of the frame.

13 Claims, 11 Drawing Sheets

U.S. PATENT DOCUMENTS

| | | | | |
|---|---|---|---|---|
| 5,732,423 | A | 3/1998 | Weismiller et al. | |
| 5,806,111 | A | 9/1998 | Heimbrock et al. | |
| 5,906,016 | A | 5/1999 | Ferand et al. | |
| 6,003,174 | A | 12/1999 | Kantrowitz et al. | |
| 6,058,531 | A * | 5/2000 | Carroll | 5/430 |
| 6,178,575 | B1 | 1/2001 | Harada | |
| 6,182,310 | B1 | 2/2001 | Weismiller et al. | |
| 6,256,812 | B1 | 7/2001 | Bartow et al. | |
| 6,289,536 | B1 | 9/2001 | Betson | |
| 6,315,319 | B1 * | 11/2001 | Hanson et al. | 280/650 |
| 6,321,878 | B1 | 11/2001 | Mobley et al. | |
| 6,357,065 | B1 | 3/2002 | Adams | |
| 6,421,854 | B1 | 7/2002 | Heimbrock | |
| 6,473,921 | B2 | 11/2002 | Brooke et al. | |
| 6,505,365 | B1 | 1/2003 | Hanson et al. | |
| 6,601,251 | B2 | 8/2003 | Paul | |
| 6,615,430 | B2 | 9/2003 | Heimbrock | |
| 6,640,360 | B2 | 11/2003 | Hornbach et al. | |
| 6,675,415 | B2 | 1/2004 | Wong | |
| 6,694,549 | B2 | 2/2004 | Perez et al. | |
| 6,701,554 | B2 | 3/2004 | Heimbrock | |
| 6,708,358 | B2 | 3/2004 | Hensley | |
| 6,779,209 | B2 | 8/2004 | Ganance | |
| 6,880,186 | B2 | 4/2005 | Johansson | |
| 6,957,461 | B2 | 10/2005 | Osborne et al. | |
| 7,062,805 | B2 | 6/2006 | Hopper et al. | |
| 7,073,220 | B2 | 7/2006 | Simmonds et al. | |
| 7,086,103 | B2 | 8/2006 | Barthelt | |
| 7,234,178 | B2 | 6/2007 | Qi | |
| 7,296,312 | B2 | 11/2007 | Menkedick et al. | |
| 7,373,677 | B2 * | 5/2008 | Barthelt | 5/618 |
| 2001/0032362 | A1 | 10/2001 | Welling et al. | |
| 2002/0059679 | A1 | 5/2002 | Weismiller et al. | |
| 2002/0066142 | A1 | 6/2002 | Osborne et al. | |
| 2002/0138905 | A1 | 10/2002 | Bartlett et al. | |
| 2002/0152551 | A1 | 10/2002 | Perez et al. | |
| 2003/0079293 | A1 | 5/2003 | Ellis et al. | |
| 2004/0034936 | A1 | 2/2004 | Welling et al. | |
| 2004/0064886 | A1 | 4/2004 | Alverson et al. | |
| 2004/0158923 | A1 | 8/2004 | Perez et al. | |
| 2004/0177445 | A1 | 9/2004 | Osborne et al. | |
| 2004/0237203 | A1 | 12/2004 | Romano et al. | |
| 2005/0011518 | A1 | 1/2005 | Biondo et al. | |
| 2005/0055779 | A1 | 3/2005 | Damewood | |
| 2005/0168341 | A1 | 8/2005 | Reeder et al. | |
| 2006/0059621 | A1 | 3/2006 | Poulos et al. | |
| 2006/0096029 | A1 | 5/2006 | Osborne et al. | |
| 2006/0168729 | A1 | 8/2006 | Weismiller et al. | |
| 2006/0168730 | A1 | 8/2006 | Menkedick et al. | |
| 2006/0179571 | A1 | 8/2006 | Newkirk | |
| 2006/0195984 | A1 | 9/2006 | HakamiuN et al. | |
| 2006/0200905 | A1 | 9/2006 | Barth et al. | |
| 2006/0277683 | A1 | 12/2006 | Lamire et al. | |

OTHER PUBLICATIONS

Brochure, *The Hill-Rom difference, TotalCare® System*, 12 pages, Sep. 7, 2005.

Service Manual, TotalCare® Bed System From Hill-Rom, Nov. 1997, Copy of Manual Front Page and pp. i-xx of 640 pages.

Service Manual, VersaCare® Bed From Hill-Rom, Feb. 2004, Manual Front Page and pp. i-xvi of 367 pages.

* cited by examiner

TWIN SCISSOR LIFT MECHANISM

FOUR WAY EQUAL PLATFORM TILTING MECHANISM 2

Arm Rail Mechanism

COMFORT SIDE CHAIR EGRESS MECHANISM

Comfort Side Standing
Egress Mechanism

HOSPITAL BEDS WITH A ROTATING SLEEP SURFACE THAT CAN TRANSLATE INTO A CHAIR CONFIGURATION

RELATED APPLICATIONS

This application claims priority to U.S. Provisional Application Ser. No. 60/668,859, filed Apr. 6, 2005.

FIELD OF THE INVENTION

The present invention relates to beds for use in hospitals, nursing homes or residential homes.

SUMMARY OF EMBODIMENTS OF THE INVENTION

Embodiments of the present invention are directed to beds with rotating sleep surfaces that can be configured to sit into a chair and also may stand a patient up like a lift chair on the side of the bed.

The present invention includes 8" casters for specific ease of steering.

The present invention includes a braking system operated by hydraulics whereby the casters may be locked and released with one cylinder. Components of the braking system thereof are strategically located inside the bottom frame rails.

The present invention includes a steering system that is spring loaded to the floor and lifted with a hydraulic cylinder The present invention includes a twin scissor mechanism actuated by a cylinder with a cylinder extension so that the mechanism may operate at full extension in a confined space.

The present invention includes a rotating sleep surface mounted to the center frame at the top of the scissors allowing operating rotation of 360 degrees.

The present invention includes a mounted platform system attaching to the rotating sleep surface that allows the upper frame to tilt around the four-way platform at optimal degrees of tilt.

The present invention includes arm rails that are mounted to the main frame operated by pin or latch release to allow straight in and out movement. The rail is spring loaded and will automatically release when the pin or latch is activated. The up/down feature will stop at designated points along the back of the rack and is controlled by a rack and pinion guide system.

The present invention includes side egress chair capabilities allowing the entire sleep surface to rotate 360 degrees left or right of center and can transition to a seated position at 90 degrees left or right of center. This side egress chair position is locked at 90 degrees, 180 degrees and 270 degrees.

The present invention includes side egress lift chair allowing the patient to transition from a suspended comfort position to a chair position to a gentle walkout exit position. Walkout exits are obtainable at 90 degrees and 270 degrees.

The present invention allows 30 degree tilt which is easily achieved by main frame proximity to the floor when the scissors are raised to a predetermined height.

The present invention will be described hereafter with reference to the attached drawings that are given as non-limiting examples.

DETAILED DESCRIPTION OF EMBODIMENTS OF THE INVENTION

PCV Braking Mechanism

Figure 1:
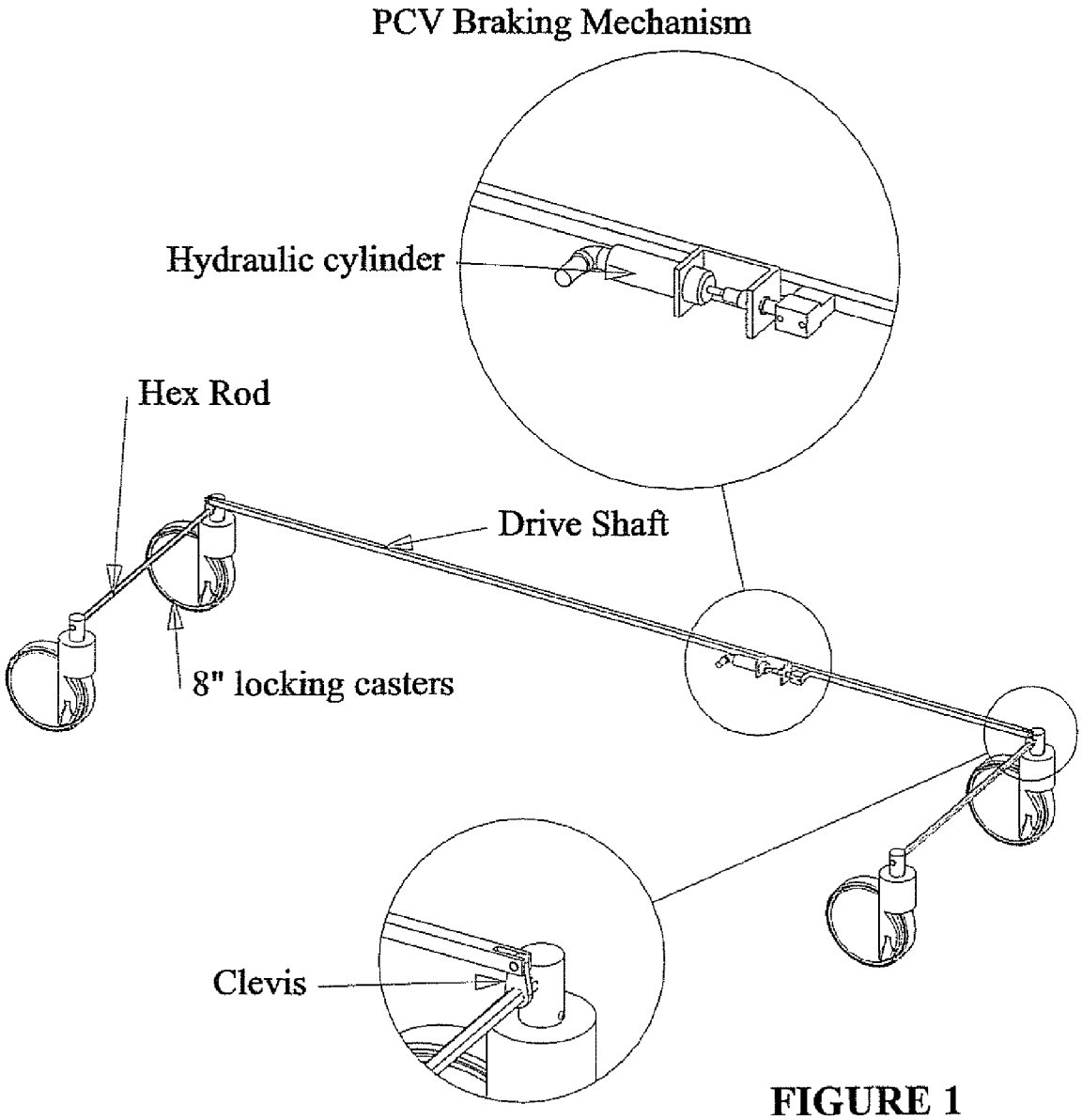
FIG. 1 is a perspective view of a PCV Braking Mechanism.

FIG. 1 illustrates the PCV Braking mechanism is made of 4-8 inch locking casters, 2 -hex rods, 1 -drive shaft bar, 1 -hydraulic cylinder, 2 -clevis mounts.

The casters are mounted to the four comers of the bed into square tubes. The tubes are drilled to allow for set screws in each caster and to slide a full length hex rod through the head of the caster to lock the brakes. The hex rod is put through the short 1 by 3 inch frame tube on both ends of the bed. A clevis is mounted to one end of each of the hex rods. The drive shaft bar is mounted to the clevis on each end. The drive shaft bar runs through the long 1 by 3 tube. There is a slot cut into the side of the long tube to connect the hydraulic cylinder to the drive shaft bar. When activated the cylinder rocks the clevis, the clevis rotates the hex rod and locks or unlocks the brakes on all 4 of the casters.

PCV Steering Mechanism

Figure 2:
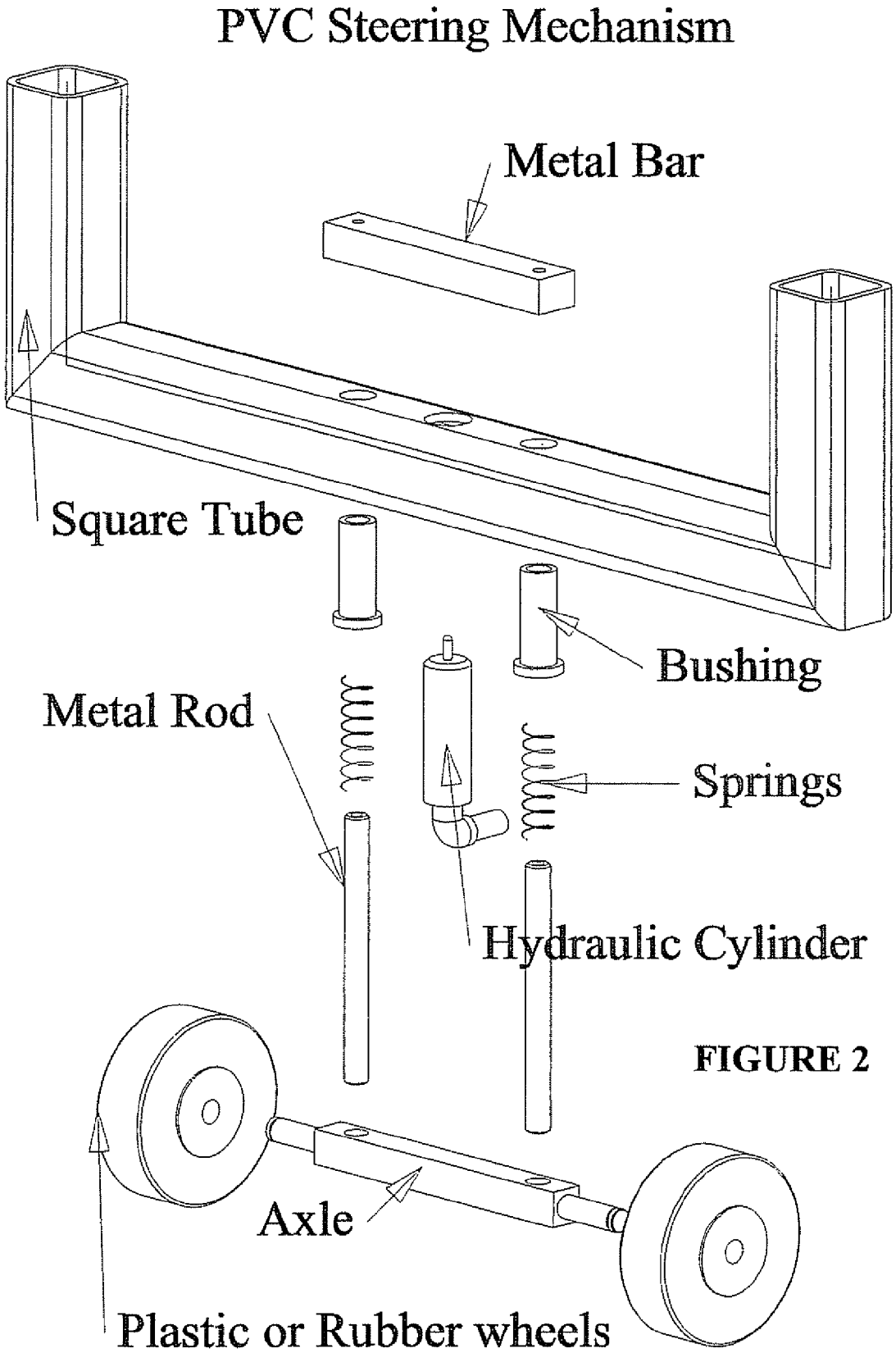
FIG. 2 is an exploded side perspective view of a PCV Steering Mechanism.

FIG. 2 illustrates the steering mechanism is made of 2 plastic or rubber wheels, springs, hydraulic cylinder, metal rods and square tubes.

The steering mechanism is mounted to the frame with 3 metal square tubes that are welded to the main base frame. There are holes in the cross section of tube to mount the spring loaded rods to and put the threaded hydraulic cylinder through. The spring loaded rods are attached to the bar the casters are mounted to so the springs keep them on the floor. There is a bar that connects above the square tube to the spring loaded bars to make sure they stay straight up and down. It is the same bar that the hydraulic head pushes on to lift the casters off of the ground. This keeps the casters on the floor until the bed needs to be moved side to side when the cylinder will raise them. This mechanism allowed us to push the bed 60 feet in a straight line by itself.

Twin Scissor Lift Mechanism

Figure 3A:
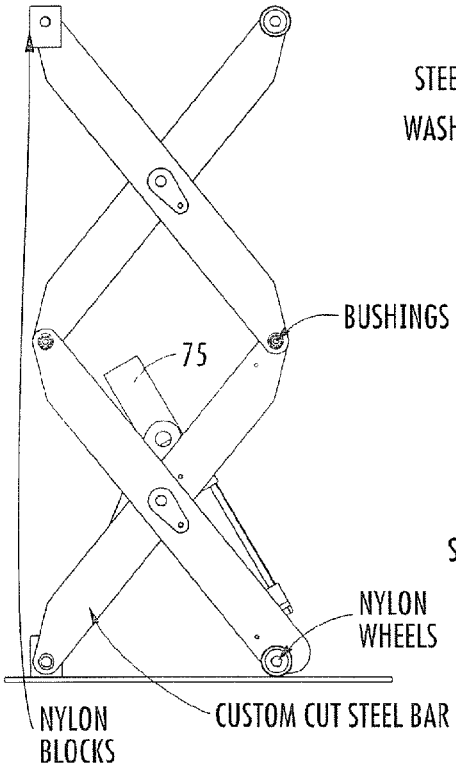
FIG. 3A is a side view of a Twin Scissor Lift Mechanism in an extended lift configuration.
Figure 3B:
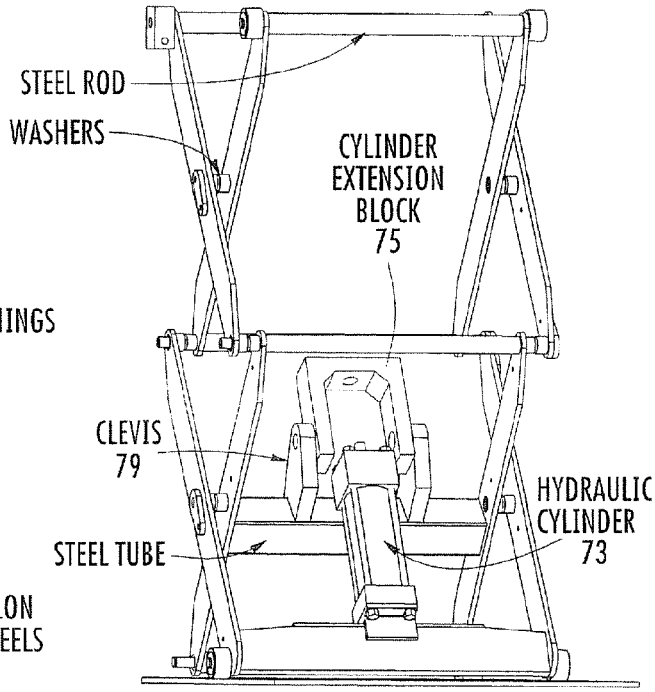
FIG. 3B is an end perspective view of the Twin Scissor Lift Mechanism shown in FIG. 3A.
Figure 3C:
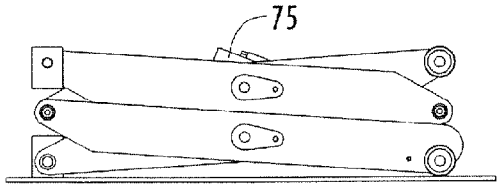
FIG. 3C is a side view of the device shown in FIG. 3A, illustrated in a collapsed configuration.

FIGS. 3A-3C illustrate the twin scissor mechanism is made of custom cut steel bars. steel rods, steel tube, copper or nylon bushings, copper or nylon washers, cylinder extension block 75, nylon blocks and wheels, and can be driven by hydraulics cylinders, air cylinders, air bags, or several electric mechanisms. We chose the hydraulic cylinder because of load we want to lift. We plan to build less expensive models with the other mechanisms in the future.

The scissor mechanism has 8 scissor arms mounted with welds and washers between them to 6 cross structural support rods, 1 cross structural support bar and 1 cross structural support tube. The cross structural support tube has 2 clevis arms 79 welded to it and a custom designed cylinder extension 75 mounted to clevis arms 79 with bushing and washers so the extension 75 will pivot. The bottom of the cylinder is mounted with a screw to the top of the cross structural support bar and the top of the cylinderis attached with threads to the inside of the cylinder extension block 75. This allows a larger cylinder to fit in a smaller space and get full range of motion. The top of the scissor is mounted to the bottom of the main lift surface (50, FIG. 4) and to the top of the metal scissor housing that has a metal mounting bracket that is welded to both the main lift surface and the top of the scissor housing. Inside the metal mounting brackets are nylon blocks with holes in them to lock the cross structural support rods in place and allow them to move very quietly straight up and down on one end of the scissor. The other ends are attached with channel iron. The channel iron is welded to the top of the scissor housing on both sides and the bottom of the main lift surface. The channels act as tracks for the nylon wheels to run in. The wheels move from one end (our foot end) to the other end (our head end) causing the scissors to lift. The purpose of using the scissor is to get very low and very high while having an almost square top to work around to achieve degree of tilt on all 4 sides.

Rotating Surface Mechanism

Figure 4:
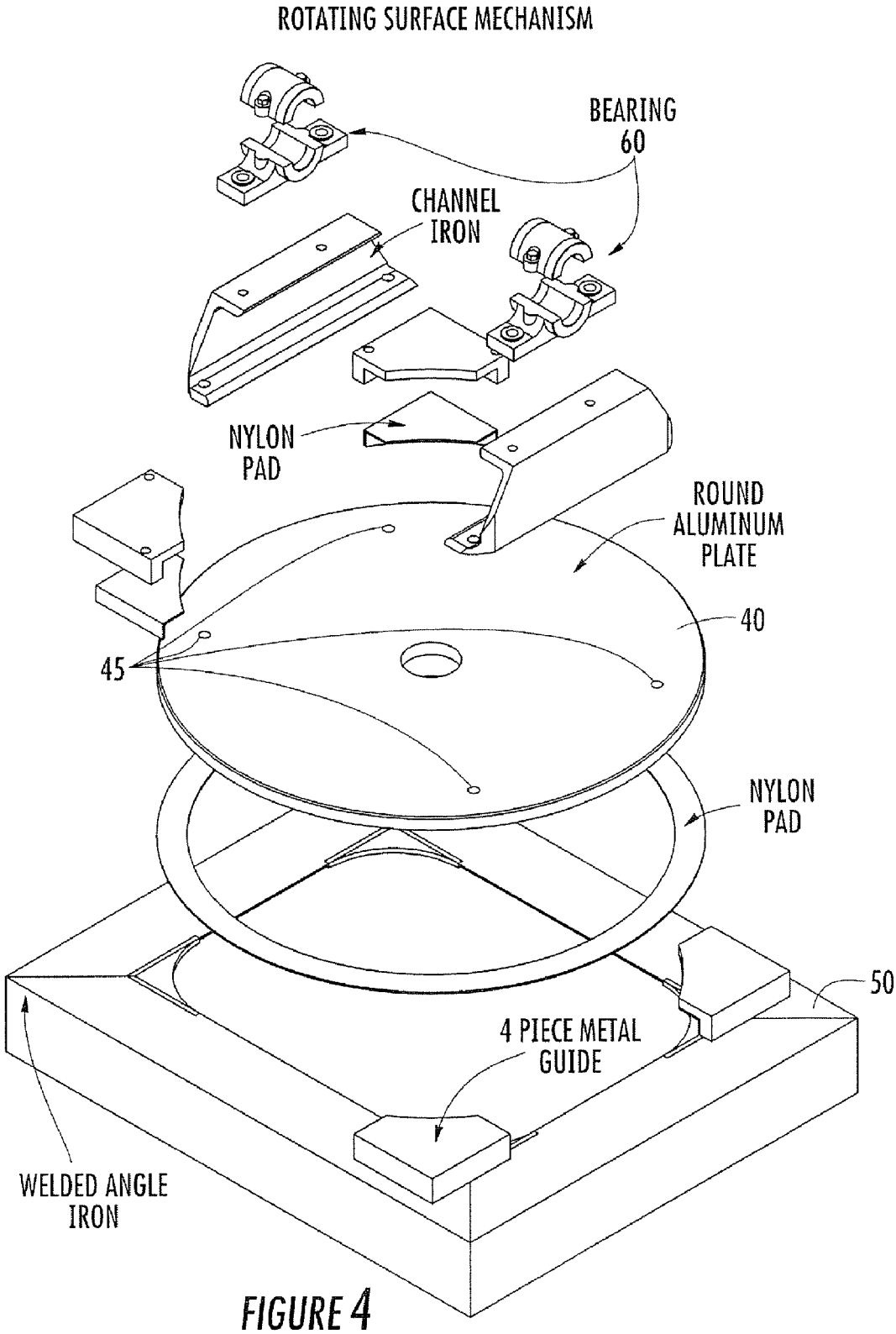
FIG. 4 is an exploded view of a Rotating Surface Mechanism.

FIG. 4 illustrates the rotating surface is made of steel angle iron, custom cut 4 piece metal guide, aluminum round plate, aluminum and steel channel, bearings, nuts, bolts, nylon pads.

The main lift surface 50 is made of 4 pieces of angle iron cut on a 45 degree angle and welded together to form four 90 degree angles. This makes the main frame 50 where everything else is attached. The flat side of the frame is on top and the wall side is faced down to the bottom. There are 2 channel tracks mounted with a weld to the bottom of the frame for the 2 scissor lift wheels to run in and 2 brackets welded to the bottom on the opposite side to make the scissor track straight up and down. The top of the surface has a custom cut round aluminum plate 40 mounted to the center. The mounts are made of steel and nylon. The bottom steel mounting brackets are welded to the frame to lock them in place and keep the round plate from moving. There are 4 custom cut nylon pieces that fit on the top and bottom of the round plate 40 inside of metal mounts for the round plate to ride on. There are 4 top metal pieces of the mount that screw into the frame top to lock the metal and nylon in place. These mounts cause the round plate 40 to make a smooth 360 degree movement. The top of the round plate has 2 pieces of channel custom cut and screwed to it to mount 2 bearings 60 and allow the sleep surface to tilt. The bearings are screwed to the top of the channel to mount the main support rod (20, FIG. 6, FIG. 10) for the sleep surface. As shown, the plate 40 includes circumferentially spaced apart apertures 45.

Four Way Equal Platform Tilting Mechanism

Figure 5A:
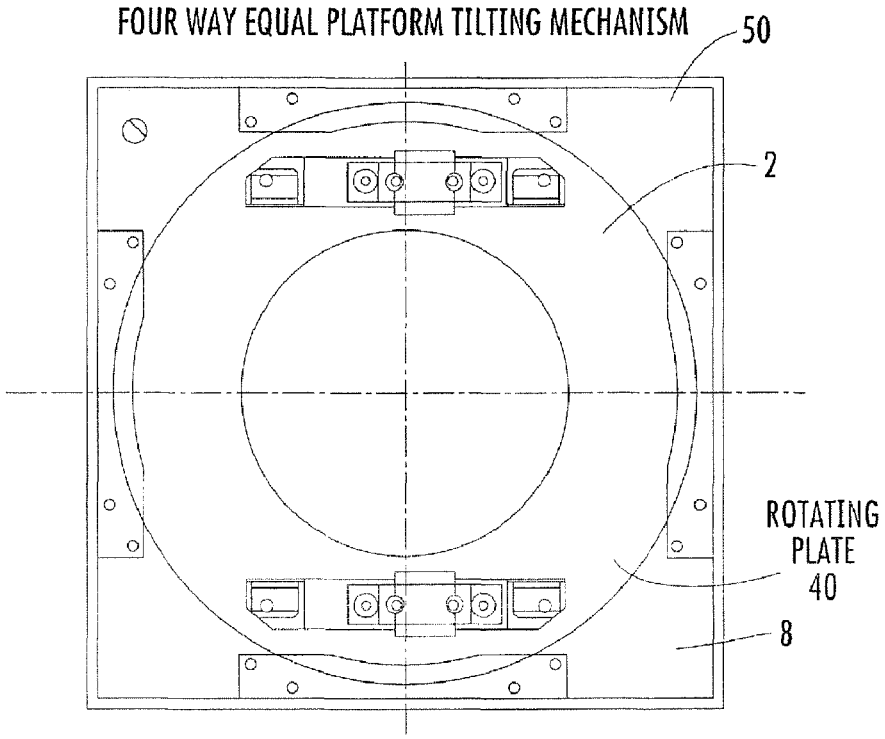
FIG. 5A is a top view of a Four Way Equal Platform Tilting Mechanism shown in FIG. 4.
Figure 5B:
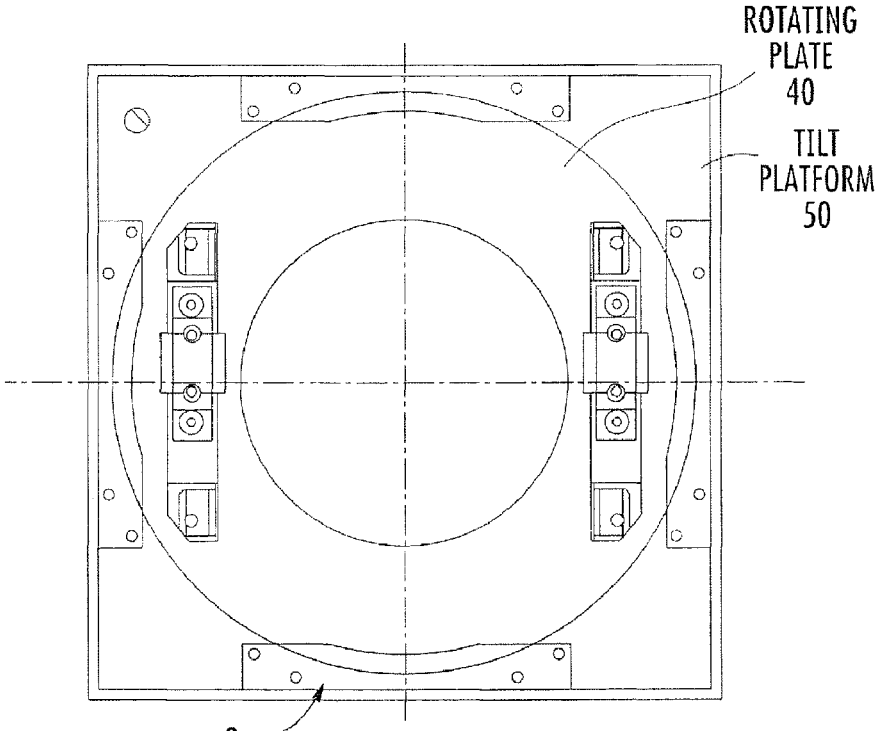
FIG. 5B is a rotated view of the Four Way Equal Platform Tilting Mechanism shown in FIG. 5A (rotated 90 degrees).
Figure 6:
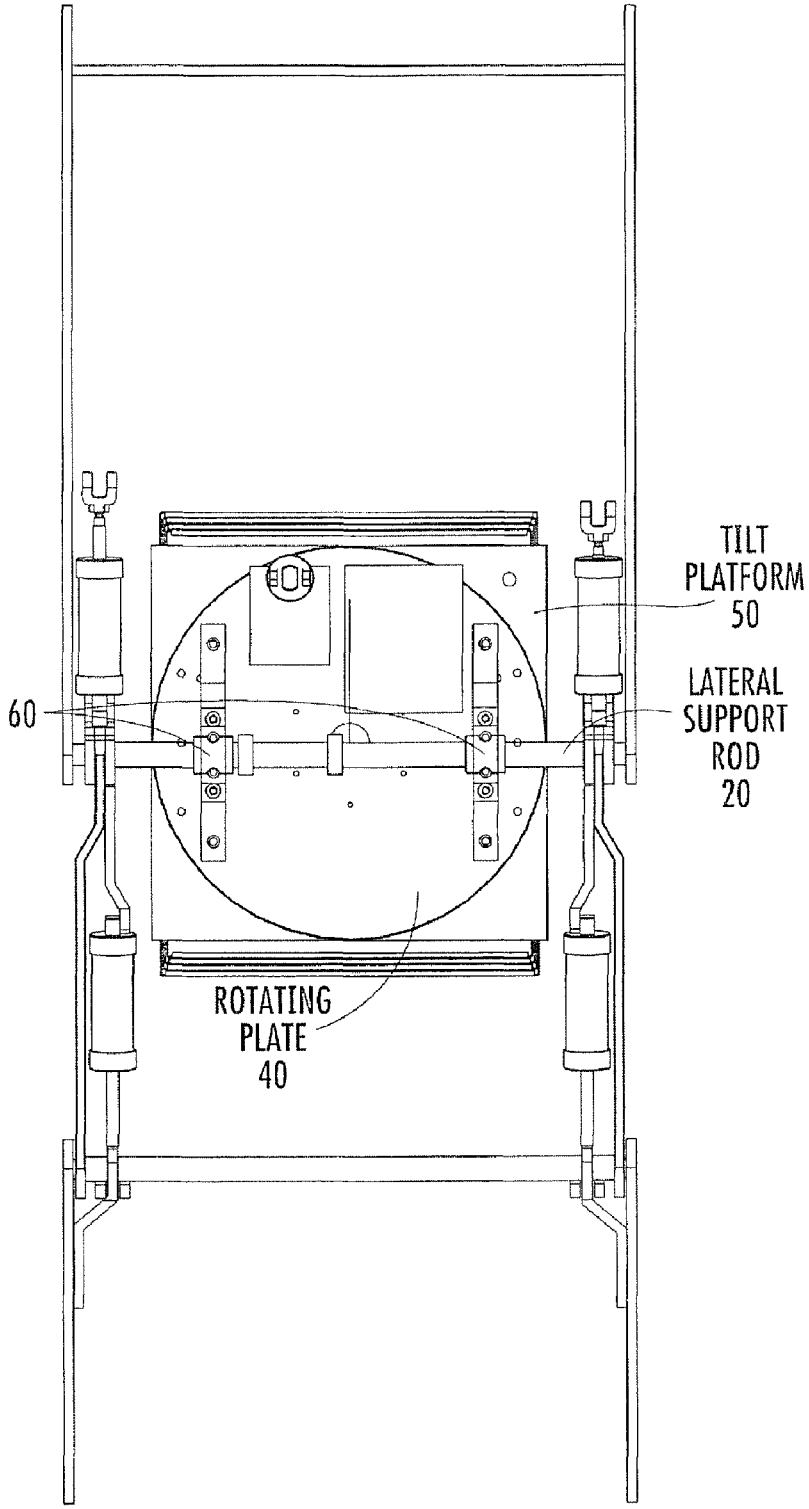
FIG. 6 is a top view of the Four Way Equal Platform Tilting Mechanism shown in FIGS. 5A and 5B shown attached to a sleep surface frame.

FIGS. 5A, 5B and 6 illustrate the Four Way Equal Platform Tilting Mechanism. The way the "Rotating Surface Frame" connects to the "Sleep Surface Frame" and the width of each allows the "Sleep Surface Frame" to fit over or around the "Rotating Surface Frame" on all sides. The "Rotating Surface Frame" has a triangle shaped main structural tilt bar mount that allows the back of the seat section or "Trend Section" to stay at an optimal degree of tilt while the front of that section fits over the "Rotating Surface Frame".

FIG. 6 illustrates the primary support rod 20 attached to bearings 60 above the tilt platform 50 under the back and seat sections 15, 16, respectively, of the patient support surface.

Arm Rail Mechanism

Figure 7A:
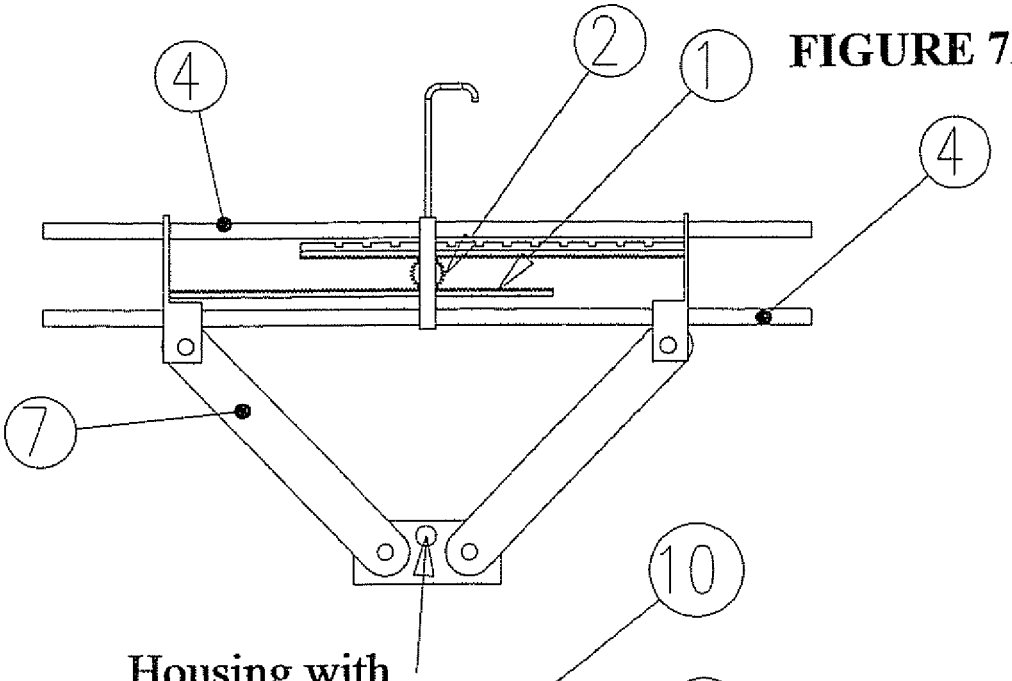
FIG. 7A is a side view of an Arm Rail Mechanism.
Figure 7B:
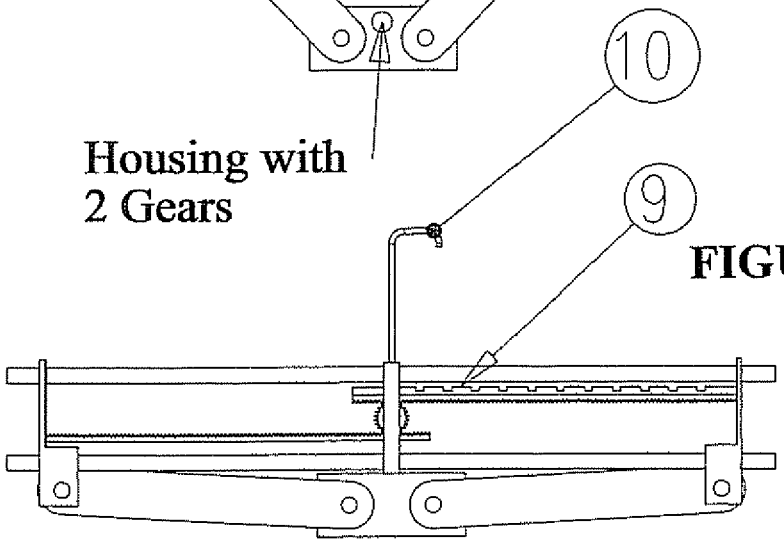
FIG. 7B is a side view of the device shown in FIG. 7A, illustrating the arm rail at first retracted position.
Figure 7C:
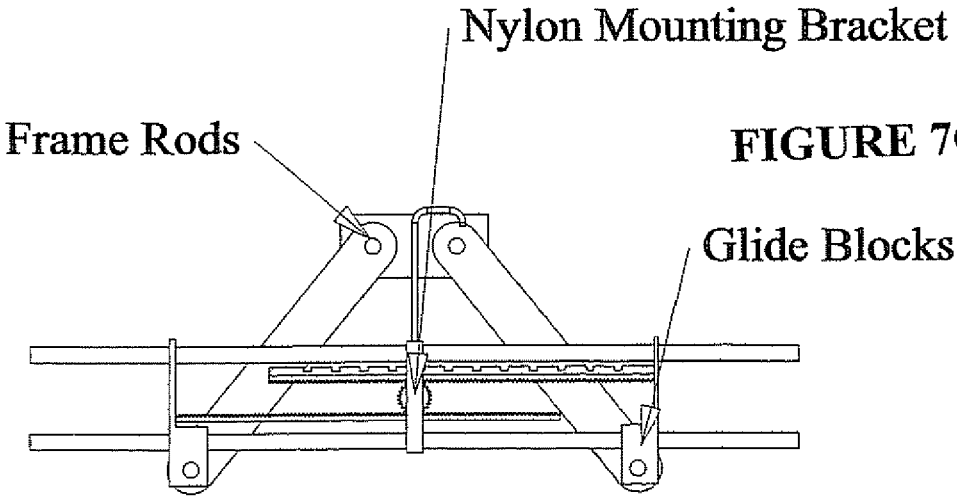
FIG. 7C is a side view of the device shown in FIG. 7A, illustrating the arm rail at a second retracted position below the position shown in FIG. 7B.

FIGS. 7A-7C illustrate the arm rail mechanism. The arm rails are made of steel, nylon, plastic gears, copper or nylon bushings, steel rods, custom cut metal blocks, snap rings, washers, rack and pinion, screws, springs, 1 latch or detent for the up-down feature and 1 latch or detent to release the rail from under the sleep surface.

The 2 frame rods are mounted through 2 holes in the sleep surface frame. The housing made of custom bent steel is mounted with screws or welded on the inside of the rail with 2 holes to house the gears and be the second guide for the 2 frame rods with bushings or washers on both sides. The frame rods are keyed to make the gears stay with the frame rods and spring loaded to push them out when they are released with the latch or manually pulled out. The custom made steel swing arms that move the rails low to high are welded to the frame rods on the outside of the bed. The glide mount rods are welded to the swing arms where there is a bushing inserted over the glide rods. The custom made glide blocks are mounted on top of the bushings with a washer on the inside and held on by snap rings on the outside. There are 2 holes in the glide blocks to mount the 2 glide slide rods though. A rack rod is mounted with the teeth facing up to the right guide block and a rack rod is mounted with the teeth facing down to the left guide block. The pinion gear is mounted in the center of the slide rods with the racks keyed into it to make sure the glide blocks move evenly in and out which causes the arm rail to travel straight up and down. The pinion is held in the center of the glide rods by a nylon mounting bracket that is screwed to the glide rods. The latch that holds the rail in any position is mounted through the top of the nylon mounting bracket stops the rails motion by hitting detent slots in the top of the upper rack.

Drawing legend:

1. Rack

2. Pinion

4. Glide Slide Rods

7. Steel Swing Arms

9. Detent Bar

10. Release Latch

Comfort Side Chair Egress Mechanism

Figure 8:
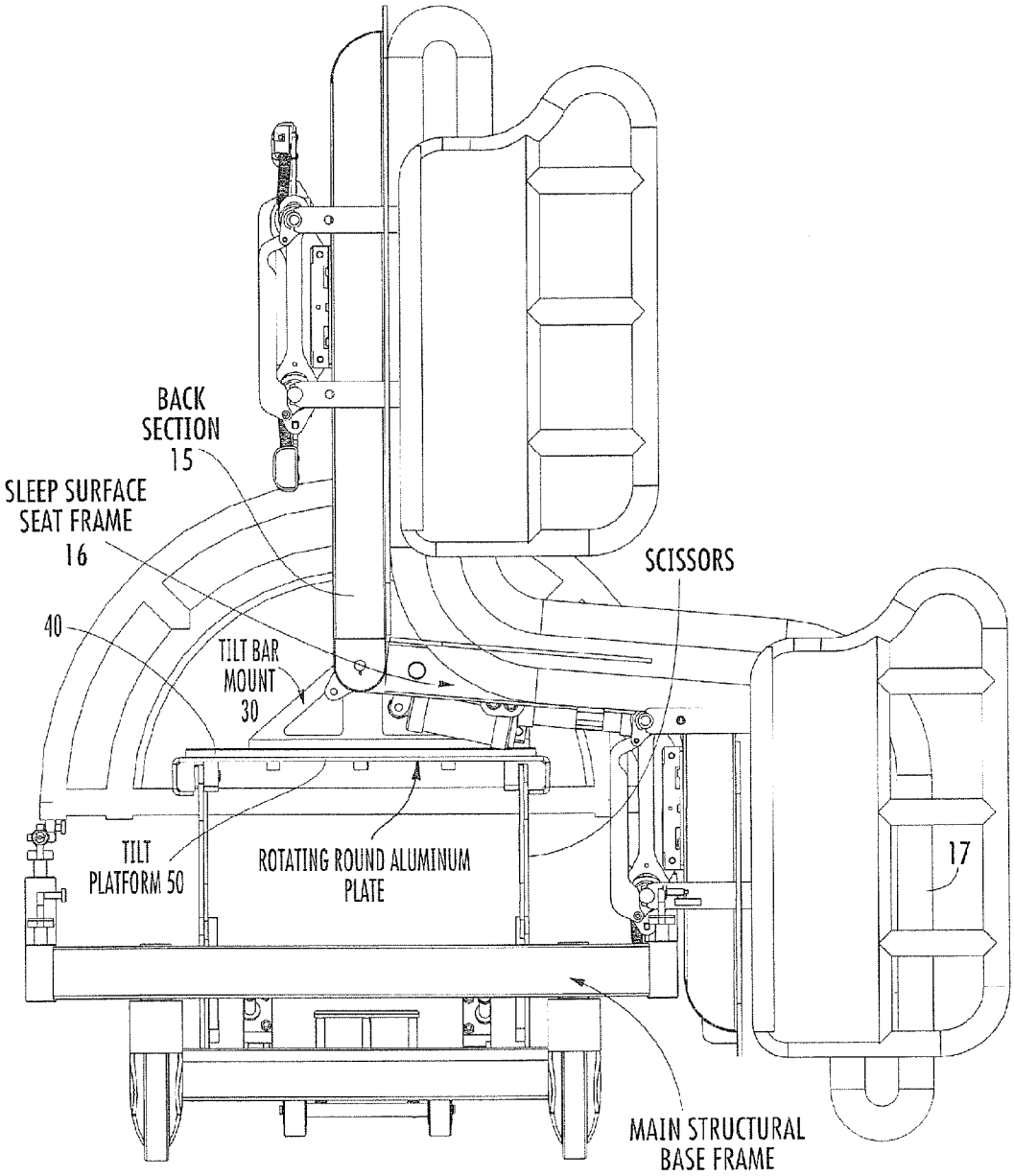
FIG. 8 is an end view (looking from the foot end) of a Comfort Side Chair Egress Mechanism.

FIG. 8 illustrates the Comfort Side Chair Egress Mechanism. The comfort side chair egress is possible by attaching the Sleep Surface Seat Frame to the main structural tilt bar mount that sits on the rotating round aluminum plate 40. The main structural tilt bar mount 30 allows the Sleep Surface Seat Frame to be stopped in a flat position. When the sleep surface frame is rotated 90 degrees to either side of the main structural base frame, the scissors are raised high enough, the foot section 17 is 90 degrees vertically to main structural base frame and the seat 16 is flat or parallel to the main structural base frame, the bed can be manually positioned by the care giver into a chair perpendicular to the main structural base frame.

Comfort Side Standing Egress Mechanism

Figure 9:
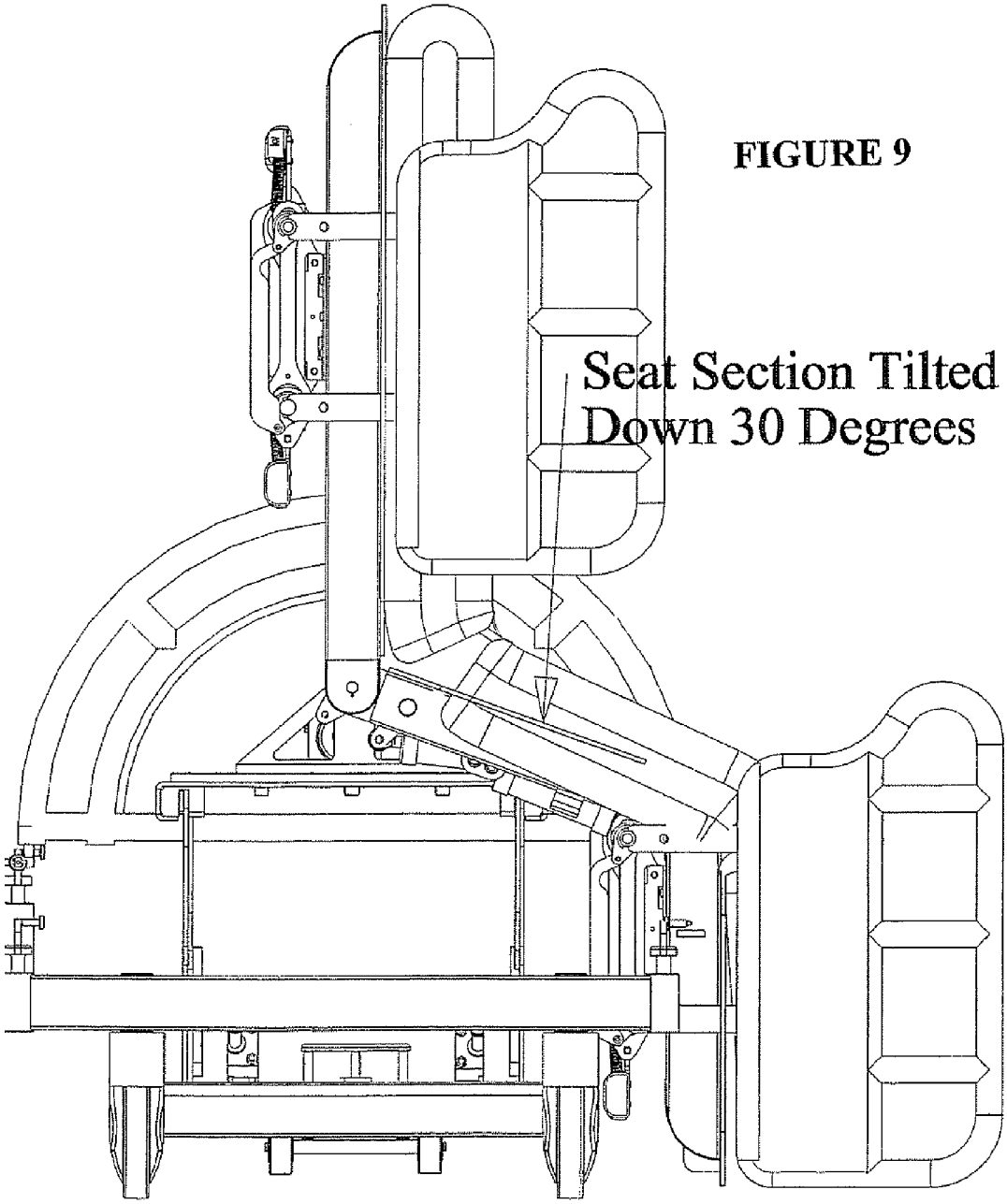
FIG. 9 is an end view (looking from the foot end) of the device shown in FIG. 8 with the bed translated into a Comfort Side Standing Egress configuration.

FIG. 9 illustrates the Comfort Side Standing Egress Mechanism. The comfort side standing egress is possible by attaching the Sleep Surface Seat Frame to the main structural tilt bar mount 30 that sits on the rotating round aluminum plate 40. The height of the main structural tilt bar mount allows the Sleep Surface Seat Frame to tilt 30 degrees down at the foot end. When the sleep surface frame is rotated 90 degrees to either side of the main structural base frame, the scissors are raised high enough, the foot section is kept perpendicular to the main structural base frame and a 30 degree tilt is applied to the seat, the bed will stand the patient up on the side of the bed.

PCV Tilt Mechanism

Figure 10:
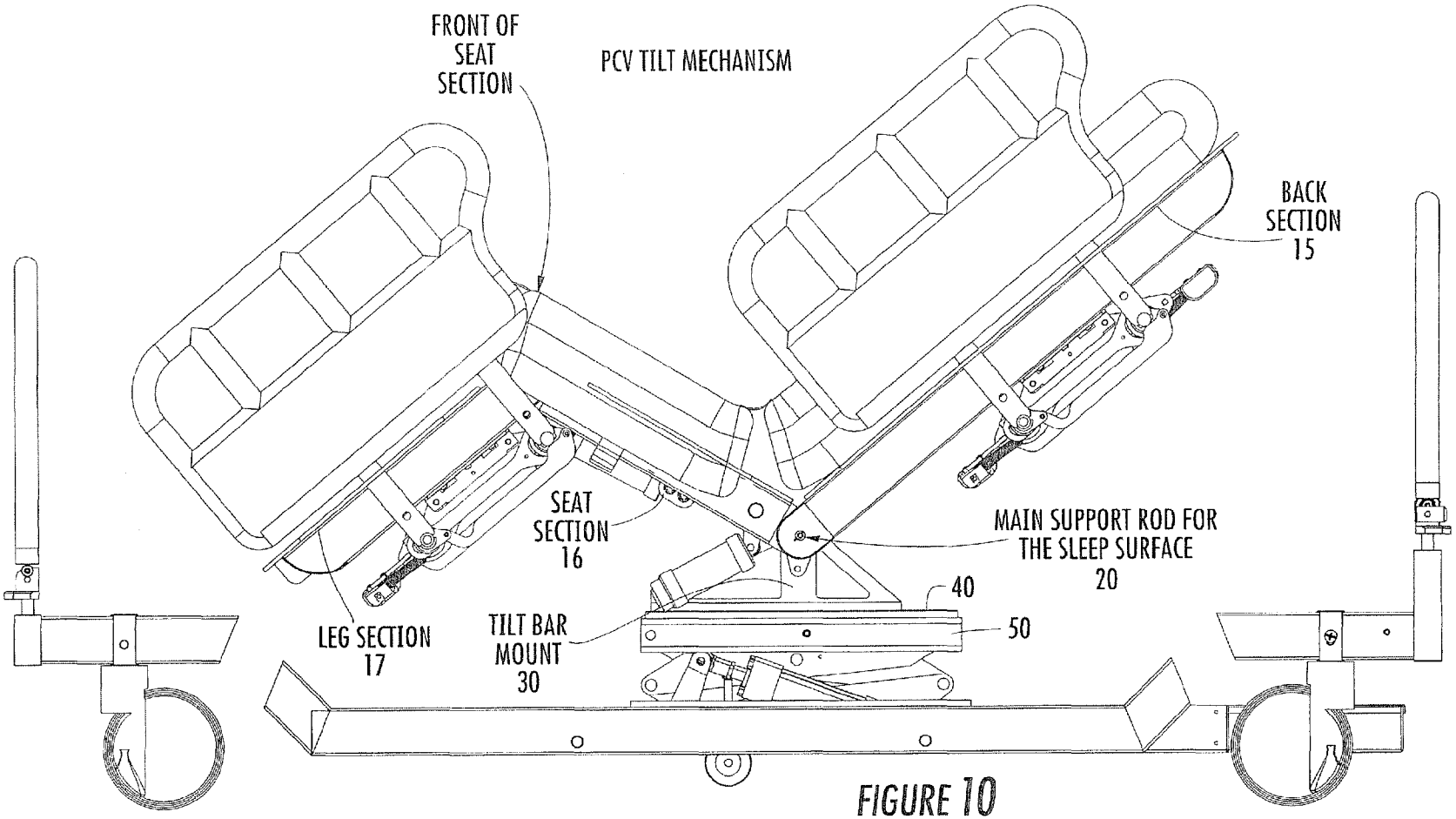
FIG. 10 is a side view of a PCV Tilt Mechanism.

FIG. 10 illustrates a PCV Tilt Mechanism. The triangle shaped main structural tilt bar mount 30 that allows the main support rod 20 for the sleep surface to stay high or lower than the foot section 17. If the main support rod 20 for the sleep surface remains higher than the front of the seat section 16 it allows for a 30 degree tilt forward. If it remains lower it allows for a 30 degree tilt backwards. The full range of motion is 60 degrees.

Manual Retracting and Extending Foot Section Mechanism

Figure 11:
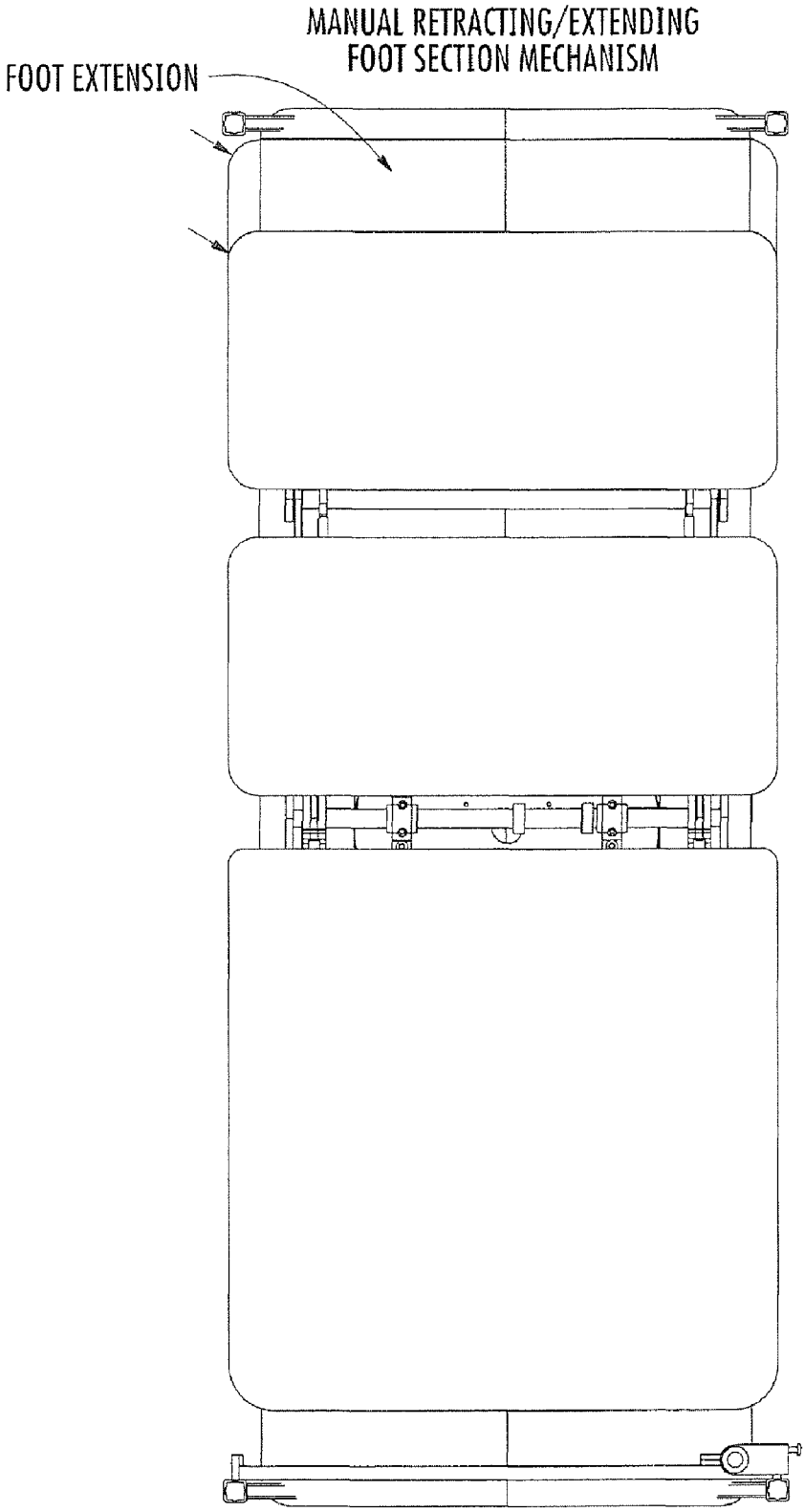
FIG. 11 is a top view of a sleep surface with a Manual Retracting/Extending Foot Section Mechanism.

FIG. 11 illustrates a sleep surface support with a Manual Retracting and Extending Foot Section Mechanism. The Manual Retracting and Extending Foot Section Mechanism located inside the "Sleep Surface Foot Frame" is made of one piece of channel iron welded to each side of the sleep surface foot frame to create a track to slide the extension in and out. There are manual stops going in and set pins on the outside to release it out. It is spring loaded to push out when the pin is released and will retract with pressure until it locks itself going in.

That which is claimed is:

1. A hospital bed, comprising:

a patient sleep surface support having back, seat and foot sections, wherein the seat section comprises first and second opposing longitudinally spaced apart end portions, the first end portion residing proximate the back section and the second end portion residing proximate the foot section;

a four way equal platform tilting mechanism attached to an underside of the patient sleep surface support proximate the seat section, the four way equal platform tilting mechanism comprising a rotating plate;

a lifting mechanism attached to and residing under the four way equal platform tilting mechanism to be able to lift the back and seat sections of the patient sleep surface support, wherein the rotating plate is configured to rotate the patient sleep surface support from a longitudinal normal orientation to a side egress orientation, and wherein the lifting mechanism and the four way equal platform tilting mechanism cooperate to move the patient sleep surface support to a side standing egress position where the seat section is tilted down so that the second end portion resides below the first end portion and the back and foot sections are substantially vertical; and a pair of side rails attached to opposing sides of the foot section and are configured to reside above the sleep surface when in the bed is in the normal orientation, wherein the side rails translate with the foot section of the patient support surface and tilt 90 degrees to reside substantially vertically in the side egress chair and stand egress positions with an upper portion of the side rails residing above the foot section and with a lower portion of the side rails residing proximate a floor.

2. The hospital bed of claim 1, wherein the patient support surface is configured to translate to a stand egress configuration with the seat section tilted downward 30 degrees with the second end portion of the seat section residing below the first end portion and the side rails have opposing horizontally extending upper and lower portions when oriented in a normal bed position that are configured to be oriented vertically when in the side-egress chair position and translate downward a distance toward a support floor one on each side of the foot section as the patient support surface translates from the side chair configuration to the stand egress configuration.

3. The hospital bed of claim 1, wherein the side rails are configured to translate with the foot section to a longitudinally extending hospital bed orientation and reside on either side of the patient support surface so that a side rail portion that resides vertically in the side egress position also resides in an orientation aligned with the orientation of the foot section when the patient support surface is in a normal bed orientation.

4. The hospital bed of claim 1, wherein the rotating plate is round and the four way equal platform tilting mechanism has a platform with an open center and a perimeter with corners that trap an outer edge of the rotating plate, the rotating plate configured to allow a user to lock the rotating plate in a side egress position.

5. The hospital bed of claim 1, wherein the patient support surface can translate to a comfort position whereby the seat section is tilted up 30 degrees while the back and foot sections are tilted down so that the seat section second end portion resides above the seat section first end portion.

6. The hospital bed of claim 1, wherein the seat section is tilted up at 30 degrees in a comfort position so that the seat section second end portion resides above the seat section first end portion, is horizontal at the side egress chair position, and is titled down 30 degrees in the stand egress position.

7. The hospital bed of claim 1, wherein the rotating plate supports a tilt bar mount that resides directly above the plate and is attached to a single laterally extending main support bar that resides above the plate, wherein the main support bar is attached to an underside of a seat section frame directly above a portion of the plate, and wherein the laterally extending main support bar is rotatably attached to the tilt bar mount using two laterally spaced apart bearings and is configured to lift the back, seat and foot sections of the bed.

8. A hospital bed, comprising:

a patient sleep surface support having back, seat and foot sections, wherein the seat section comprises first and second opposing longitudinally spaced apart end portions, the first end portion residing proximate the back section and the second end portion residing proximate the foot section;

a four way equal platform tilting mechanism attached to an underside of the patient sleep surface support proximate the seat section, the four way equal platform tilting mechanism comprising a rotating plate;

a lifting mechanism attached to and residing under the four way equal platform tilting mechanism to be able to lift the back and seat sections of the patient sleep surface support, wherein the rotating plate is configured to rotate the patient sleep surface support from a longitudinal normal orientation to a side egress orientation, wherein the rotating plate supports a tilt bar mount that resides directly above the rotating plate, wherein the tilt bar mount is attached to a laterally extending main support bar that also resides directly above the rotating plate and is attached to a seat section frame wherein the lifting mechanism resides under the tilt bar mount and beneath the rotating plate and is configured to lift the back, seat and foot sections concurrently, and wherein the lifting mechanism and the four way equal platform tilting mechanism cooperate to move the patient sleep surface support to a side standing egress position where the seat section is tilted down so that the second end portion resides below the first end portion and the back and foot sections are substantially vertical.

9. A hospital bed, comprising:

a patient sleep surface support having back, seat and foot sections, wherein the seat section comprises first and second opposing longitudinally spaced apart end portions, the first end portion residing proximate the back section and the second end portion residing proximate the foot section;

a four way equal platform tilting mechanism attached to an underside of the patient sleep surface support proximate the seat section, the four way equal platform tilting mechanism comprising a rotating plate; and a lifting mechanism attached to and residing under the four way equal platform tilting mechanism to be able to lift the back and seat sections of the patient sleep surface support;

wherein the rotating plate is configured to rotate the patient sleep surface support from a longitudinal normal orientation to a side egress orientation, whereby the lifting mechanism and the four way equal platform tilting mechanism cooperate to move the patient sleep surface support to a side standing egress position where the seat section is tilted down so that the second end portion resides below the first end portion and the back and foot sections are substantially vertical, and wherein the four way equal platform tilting mechanism includes a tilt bar mount that resides on a flat upper surface of the rotating plate, the tilt bar mount having an upwardly extending triangular shape when viewed from the side with an upper peak portion of the triangular shape residing above the plate and being attached to a laterally extending main support rod, and wherein the laterally extending main support rod attaches to and resides directly under an underside of a seat section frame of the sleep surface support and directly above a portion of the rotating plate.

10. The hospital bed of claim 9, wherein the main support rod can translate to be higher or lower than the front portion of the seat section, and wherein if the main support rod is higher than the front of the seat section, the seat section can tilt forward 30 degrees and if the main support rod is lower than the front of the seat section, the seat section can tilt backward 30 degrees, and wherein the patient sleep surface support can translate to a comfort position wherein the back section is tilted backward, while the seat section is tilted upward 30 degrees and the foot section is tilted downward.

11. The hospital bed of claim 9, wherein when the tilt bar mount lifts the laterally extending main support rod above a front of the seat section, the seat section can tilt forwardly at 30 degrees and when the tilt bar mount moves the laterally extending support rod to reside below the front of the seat section, the seat section can recline rearwardly at 30 degrees thereby allowing for the full range of tilt motion of the seat section of 60 degrees.

12. A hospital bed, comprising:

a patient sleep surface support having back, seat and foot sections, wherein the seat section comprises first and second opposing longitudinally spaced apart end portions, the first end portion residing proximate the back section and the second end portion residing proximate the foot section;

a four way equal platform tilting mechanism attached to an underside of the patient sleep surface support proximate the seat section, the four way equal platform tilting mechanism comprising a rotating plate; and a lifting mechanism attached to and residing under the four way equal platform tilting mechanism to be able to lift the back and seat sections of the patient sleep surface support;

wherein the rotating plate is configured to rotate the patient sleep surface support from a longitudinal normal orientation to a side egress orientation, whereby the lifting mechanism and the four way equal platform tilting mechanism cooperate to move the patient sleep surface support to a side standing egress position where the seat section is tilted down so that the second end portion resides below the first end portion and the back and foot sections are substantially vertical, and wherein the rotating plate is configured to be able to rotate the patient support surface 360 degrees.

13. The hospital bed of claim 12, wherein the seat section has a full range of tilt motion of 60 degrees, 30 degrees of forward tilt and 30 degrees of rearward tilt.

* * * * *